US008128506B2

(12) United States Patent
Quirk

(10) Patent No.: US 8,128,506 B2
(45) Date of Patent: Mar. 6, 2012

(54) GOLF CLUB

(76) Inventor: Graeme Quirk, Ferntree Gully (AU)

( * ) Notice: Subject to any disclaimer, the term of this patent is extended or adjusted under 35 U.S.C. 154(b) by 0 days.

(21) Appl. No.: 12/148,640

(22) Filed: Apr. 21, 2008

(65) Prior Publication Data

US 2008/0261712 A1 Oct. 23, 2008

(30) Foreign Application Priority Data

Apr. 23, 2007 (AU) ..... 2007902095

(51) Int. Cl.
*A63B 69/36* (2006.01)

(52) U.S. Cl. ..... 473/257; 473/250

(58) Field of Classification Search ..... 473/219, 473/240, 250, 251, 252, 253, 254, 257, 340; 273/DIG. 14

See application file for complete search history.

(56) References Cited

U.S. PATENT DOCUMENTS 3,866,922 A * 2/1975 Marci et al. ..... 473/250
3,873,094 A 3/1975 Sebo et al.
4,222,566 A * 9/1980 Berry ..... 473/250
4,369,974 A * 1/1983 Komperda ..... 473/250
4,456,257 A 6/1984 Perkins
5,467,989 A 11/1995 Good et al.
5,964,669 A * 10/1999 Bloomer ..... 473/250
6,227,982 B1 5/2001 Wurster
6,394,910 B1 * 5/2002 McCarthy ..... 473/251
2004/0242344 A1 12/2004 Williams et al.
2006/0040758 A1 2/2006 Coates
2006/0040762 A1 2/2006 Chupka et al.
2006/0063607 A1 3/2006 Crossley

* cited by examiner

*Primary Examiner* — Nini Legesse
(74) *Attorney, Agent, or Firm* — Law Office of John W. Harbst

(57) ABSTRACT

A golf club having a head with a face configured to contact a ball and a shaft attached to the head at a first end such that the first end extends into and is received within the head. The shaft is gripped by a golfer at a second end so as to be swung by the golfer to head strike the ball. The head is configured to provide the golfer with a visual indication of the position of the first end of the shaft such that the position of first end of the shaft is monitored during the swing. The visual indication can be provided by a transparent region and highlighting the first end of the shaft.

9 Claims, 6 Drawing Sheets

GOLF CLUB

CROSS REFERENCE TO RELATED APPLICATION

This patent application claims priority from Australian Patent Application No. 2007902095 and the contents of that specification are incorporated herein by reference.

FIELD OF THE INVENTION

The present application relates to a device and method for training a user to swing a golf club, more particularly, the present invention relates to a golf club and method of using the golf club that aids a player in monitoring and/or correcting their swing during a golf stroke.

BACKGROUND OF THE INVENTION

The game of golf is widely played throughout most countries of the world. Golf is played by people of either gender and of various ages and the game accommodates people of varying ability.

Golf is a particularly challenging sport that requires much skill and endeavour to deal with the technical aspects of the game, as well as the random aspects that occur in outdoor sports exposed to the elements of nature. Whilst the elements of nature can rarely be controlled, the technical aspects of the game, including the swing action and various other swing attributes, can be refined and improved to provide a player with a relatively consistent swing action between individual shots. The ability to strike the ball in a consistent manner with a degree of accuracy is a constantly being sought by golfers of all ages and abilities.

For this reason a variety of training tools have been developed in order to aid a golfer in developing a consistent and desirable swing action. Such aids take the form of arm braces, gloves and other such devices that are worn or carried by the golfer when practicing. Many such devices are directed towards addressing any one of a number of deficiencies, however they rarely attempt to address the essence of the swing technique, the ability to swing the golf club within a desired plane. As all golf clubs are made with an inclined lie angle from the head to the shaft, each club is typically swung on an inclined plane. Ideally, the golf club should swing within a plane that contains the golf ball to be hit in a desired direction, from initial address of the ball, through the back swing and downswing of the club, and through the follow-through of the stroke. As each club has a different length and lie angle, each club is essentially swing on a different inclined swing plane. Therefore, it is the ability to swing the club such that its swing path remains within the desired plane that determines the control of the ball being hit.

One problem with swinging the club so as to ensure that it remains within the desired swing plane is the invisible nature of the desired swing plane. Whilst a golfer may be aware of the need to maintain their swing within the desired swing plane that contains the ball and the desired line of trajectory that the ball is to take, without a visual indication of the desired swing plane, it is difficult for the golfer to determine if and/or when their swing goes outside the swing plane. Therefore, it is hard for the golfer to make appropriate swing corrections to address such a problem.

A number of devices have been provided to assist a golfer in monitoring the swing path as the golfer swings the club. The most common devices incorporate lasers or other types of light sources which are located parallel to the shaft of the club, or within the shaft of the club, such that the golfer can trace the swing path of the club by tracking the light emitted from the club on a ground surface. Whilst such devices can provide the golfer with an indication of such a swing path, the golfer must extrapolate the visual indication in order to determine whether they are swinging the club in the desired swing plane. As the device is typically attached externally to the club, it can impede the swing and hence it is often difficult for the golfer to produce a swing that replicates their natural swing. For devices that are incorporated into the club, the club is often foreign to the golfer and as such the golfer may not swing in the same manner as they would naturally swing when using their own clubs. As a result, existing devices do not provide an accurate way in which the golfer can monitor and assess whether their swing falls outside the desired swing plane during a stroke.

There is a need to provide a golf club and/or training device and a method of using the golf club and/or training device that provides a golfer with a simple means by which to monitor their swing path during a swing and which overcomes the need for bulky attachments and the like.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

According to a first aspect, the present invention provides a golf club comprising:

a head having a face configured to contact a ball; and a shaft attached to the head at a first end such that the first end extends into and is received within the head, the shaft being configured to be gripped by a golfer at a second end so as to be swung by the golfer such that the face of the head strikes the ball thereby imparting motion to the ball;

wherein the head is configured to provide the golfer with a visual indication of the position of the first end of the shaft such that the position of first end of the shaft is monitored during said swing.

In one embodiment, at least a portion of the head adjacent the first end of the shaft is transparent such that the golfer is able to see through the portion of the head to view said first end of the shaft. The first end of the shaft may be visually enhanced to facilitate viewing of the first end of the shaft during said swing. For example, the first end of the shaft may be highlighted to enhance visibility thereof compared to surrounding portions of the head by one or more of: providing said first end in a bright colour, providing the first end in a contrasting colour, providing the first end with a phosphorescent material, providing the first end with light emitting means directed towards the golfer, and providing the first end with retro-reflective material. The portion of the head adjacent the first end of the shaft may be formed such that the golfer is able to see-through the portion of the head so as to view a ground surface below the golf club.

The transparent portion of the head, as viewed by the golfer holding the club in the address position, may surround the first end of the shaft and wherein the transparent portion is configured to draw the focus of the golfer's attention to the transparent portion and to the first end of the shaft therein. For example, the transparent portion may be configured to have boundaries which when viewed by the golfer holding the club in the address position forms a visual framing of the first end of the shaft. The visual framing may be comprised by a visually demarcated concave boundary at least partially surrounding the location where the first end of the shaft extends into the head.

The head may be in the form of a conventional golf driver head, iron head or putter head. The first end of the shaft may be received within a hosel formed in the head such that the head is secured to the shaft at the first end thereof. An adhesive may be provided within the hosel to secure the first end of the shaft to the head.

The transparent portion of the head may include the entire head. In one form the transparent portion of the head may include a heel portion of the club, adjacent the hosel.

In another embodiment, the head may include a visual marker that indicates the position of the first end of the shaft. The visual marker may be in the form of a dot formed on an upper surface of the head. The dot may be located such that it is directly above/over the first end of the shaft received within the head.

According to a second aspect, the present invention provides a method for training a golfer to swing a golf club comprising:

determining a target line for a golf stroke;

addressing the target line with a golf club such that the first end of the shaft is positioned to cover or be located adjacent the target line;

swinging the golf club in accordance with the golf stroke;

monitoring the position of the first end of the shaft of the golf club during said swing; and correcting the swing where necessary to ensure that the first end of the shaft of the golf club covers, or assumes a path that is substantially parallel to, the target line throughout the swing.

According to a third aspect, the present invention provides a method of assessing a golfer's golf swing comprising the steps of:

providing on the ground a straight target line along which a golf ball placed on the line is to be impelled by the golfer swinging a golf club, with the golfer being positioned at one side of the line;

locating a video capture apparatus above the ground and directed towards the straight target line from above the golfer's head so that when the video image capture apparatus is operated the images captured thereby closely approximate the view of the golfer;

operating the video image capture apparatus to capture a sequence of images as the golfer swings a golf club in accordance with any one of claims 1 to 13 to strike the golf ball placed on the straight target line, the image capture apparatus being operated throughout at least the part of the golfer's swing when the club head approaches and travels through the impact zone where the head of the golf club strikes the golf ball, whereby the image capture apparatus captures successive images of the target scene which includes the straight target line, the golf ball, the golf club head, and at least the lower portions of the golf club shaft; and reviewing positions of the first end of the shaft in successive captured images in relation to the straight target line so as to assess the golfer's action in swinging the golf club in a desired swing plane in which the straight target line is located.

In the method according to this third aspect, the images captured by the video image capture apparatus are preferably recorded as image data in a machine readable memory, the method further including replaying the captured and recorded images by retrieving the image data from the memory and displaying images in a sequential process at a substantially slower rate than the rate at which the images were captured.

Also in the method of this third aspect, the images captured by the video image capture apparatus are preferably processed in an image analysis operation, the image analysis operation including the steps of:

identifying in each captured image the straight target line, identifying in each successive captured image a point location of the first end of the shaft, plotting the point locations in relation to the straight target line, and displaying on an image display all of the identified point locations in conjunction with an image of the straight target line to demonstrate by the displayed image the line of travel of the head of the golf club and enable inferences to be drawn about the golfer's swing.

The method may include the further step of projecting light from a location adjacent the location of the video image capture apparatus and towards the straight target line, providing the head of the golf club with a body of strongly reflective material indicating the position of the first end of the shaft, whereby the video image capture apparatus will capture successive images clearly indicating the exact location of the first end of the shaft video image by the point of strongly reflected light from the reflective body.

In an embodiment of the second or third aspects of the invention, the step of determining a target line for a golf stroke includes forming a straight line on a ground surface. The straight line may be in the form of a piece of string, paint, tape, or chalk line applied to the ground surface.

The step of addressing the target line may include placing a ball on or adjacent the target line to be hit by said club. The ball may then be addressed by the golfer in accordance with the stroke.

The step of monitoring the position of the first end of the shaft of the golf club during said swing may include viewing the position of the first end of the shaft as the club is swung. This may include viewing the position of the first end of the shaft with respect to the target line to determine whether the first end of the shaft covers, or is parallel to, the target line during the swing. In this regard, the swing includes at least that part of the movement of the club when the head approaches and passes through the impact zone where the head contacts the ball to impart motion thereto, but may also include the address, back-swing, initial part of the downstroke and follow-through portions of swing.

The step of correcting the swing may include re-positioning the golf club such that the first end of the shaft is re-positioned to cover or be positioned parallel to the target line.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

By way of example only, the invention is now described with reference to the accompanying drawings.

DETAILED DESCRIPTION OF EXEMPLARY EMBODIMENTS OF THE PRESENT INVENTION

Whilst the present invention will be described in relation to its application to a driver and a putter, it will be appreciated that the present invention could be employed in any golf club, such as an iron or fairway wood, whilst still retaining the spirit of the present invention. Similarly, whilst the present invention will be described in relation to its application to a right-handed golfer, it will be appreciated that the present invention could be equally applied for a left-handed golfer.

Figure 1:
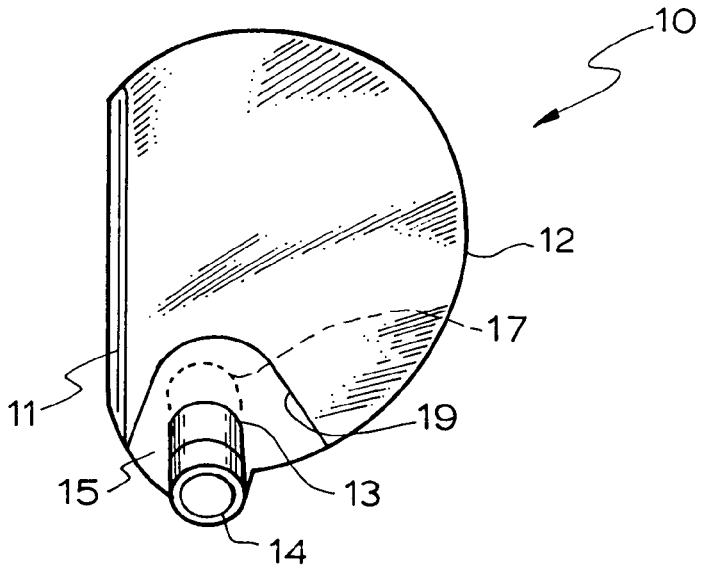
FIG. 1 shows a top view of a golf club according to one embodiment of the present invention.
Figure 2:
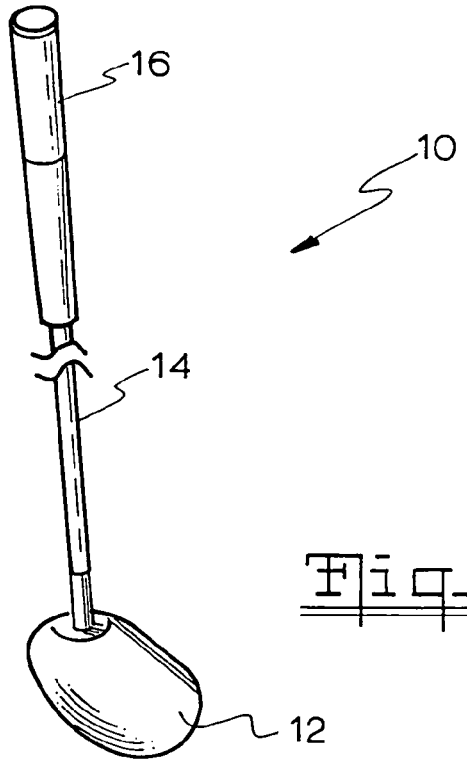
FIG. 2 shows a perspective view of the golf club of FIG. 1.

Referring to FIGS. 1 and 2, there is shown a golf club 10 in accordance with one embodiment of the present invention.

The golf club 10 is in the form of a golf wood or driver having a head 12 connected by way of a shaft 14 to a handle or grip 16. The head 12 has a face 11 that is configured to contact a ball so as to impart motion of the club head 12 to the ball (not shown). In the embodiment as shown in FIGS. 1 and 2, the face 11 is a substantially vertical face.

The shaft 14 is connected to the head 12 by inserting an end of the shaft 14 into a hosel or bore 13 and securing the end of the shaft in position. The end of the shaft 14 may be secured in position within the hosel 13 by an adhesive or the like. The angle in which the shaft 14 exits the hosel 13 defines the lie angle of the club, namely the angle between the centre line of the shaft and the sole of the club head. As mentioned above, due to each club having a different length, the lie angles differ between different clubs.

As shown in FIG. 1, the head 12 is of a conventional wood type and the region 15 of the head 12 proximal the hosel 13 is made from a see-through or transparent material. This region 15 enables the golfer to view the end 17 of the shaft 14 as it located within the hosel 13, such that the end 17 of the shaft 14 can be clearly viewed and traced during the swing motion by the golfer. To enhance tracking of the end 17 of the shaft 14, indicia or other such markings may be provided on the end 17 of the shaft to highlight its position.

The see-through or transparent region 15 is shown as being proximal the hosel 13, however, it will be appreciated that the region 15 could extend across a greater region of the club head 12 such that the head 12 is predominantly see-through/transparent. It will also be appreciated that the purpose of the region 15 is to aid the golfer in viewing and tracking the end 17 of the shaft 14 during a stroke. Hence, the region 15 should be configured in a manner such that the focus of the golfer is drawn to the end 17 of the shaft 14, rather than being distracted from this region.

Figure 3:
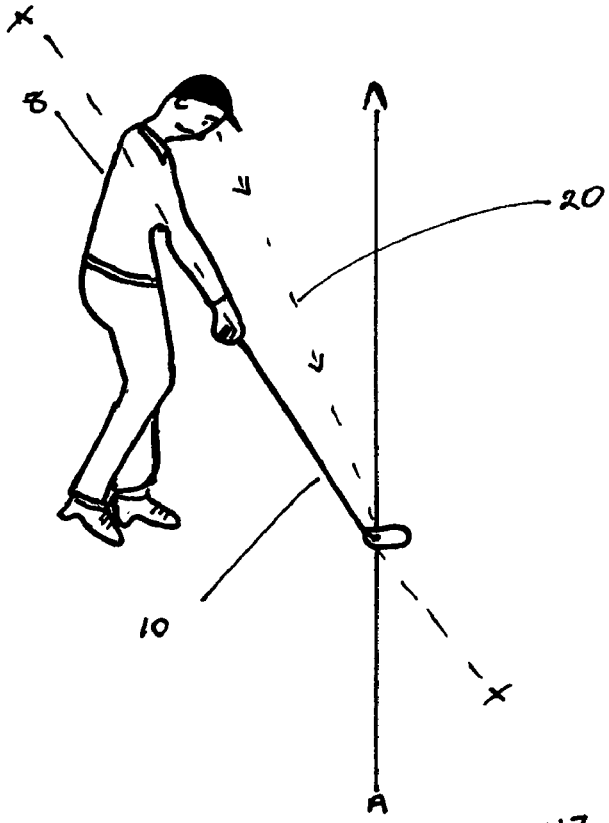
FIG. 3 shows a golfer employing a golf club in accordance with one embodiment of the present invention.
Figure 4:
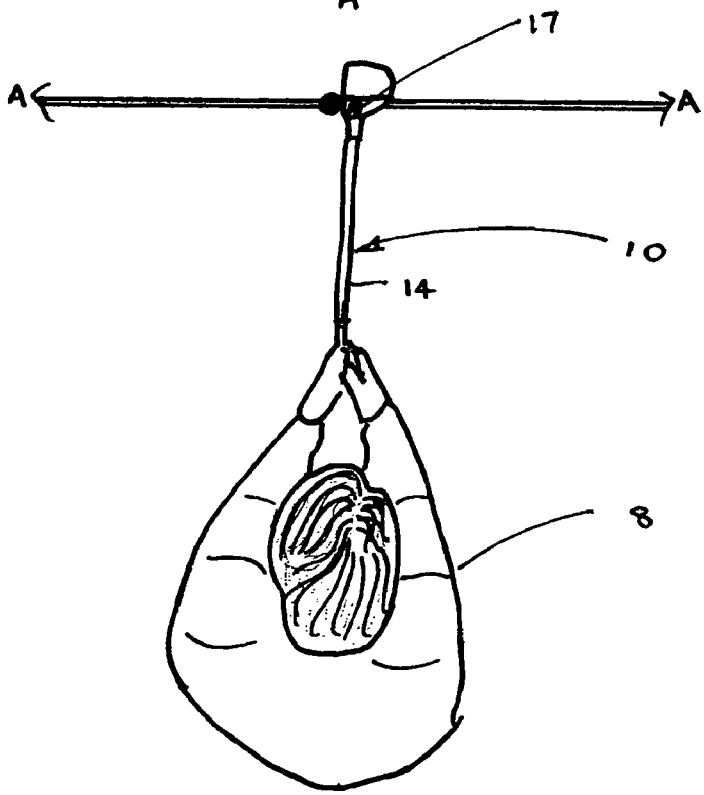
FIG. 4 shows an alternative view of the golfer of FIG. 3.

FIGS. 3 and 4 show the manner in which the club 10 according to an embodiment of the present invention can be used by a golfer 8 to monitor their swing plane.

Firstly, in order to determine the correct swing plane for a specific golfer 8, the golfer 8 must establish a set swing position. This can be achieved by the golfer 8 taking hold of the club with their left hand having their left wrist vertically oriented. The golfer then leans forward from their hips such that their left arm hangs straight down. Their right elbow is then tucked under, such that it points to the right hip. The right wrist is then turned to extend vertically such that the right elbow, forearm and shaft 14 of the club form the elbow plane angle as represented by line X-X in FIG. 3. As clearly seen, this plane X-X is inclined to the horizontal and represents the plane upon which the golfer 8 swings the club 10.

Prior to swinging the club 10, the golfer 8 determines an intended target line A-A. This line A-A is the intended straight-line extension of the swing plane X-X that the ball is to travel following contact with the club 10. Provided that the golfer 8 retains the club 10 in the swing plane X-X during the stroke, it is considered that the ball should follow the path of the target line A-A.

It has been found that the target line A-A can be used by the golfer to monitor whether they are swinging the club 10 on or along the desired swing plane X-X. This can be achieved by establishing a straight visual target line A-A, through use of a string, chalk line, shadow of a building, etc, and setting up their swing along this line in the manner as shown in FIG. 4. When in a set swing position, as discussed above, the golfer 8 is able to directly view the end 17 of the shaft 14, due to the transparent region 15 of the club head 12, such that the end 17 of the shaft 14 is located over the line A-A. This view is shown as line 20 in FIG. 3 and it will be appreciated that this view is from the perspective of the golfer 8 as the golfer 8 is making the stroke.

As the golfer 8 is positioned at the start of the stroke, he is able to view the end 17 of the shaft 14 such that it covers the line A-A. As the golfer commences the backswing of the stroke, he is able to view the position of the end 17 of the shaft 14 as the club 10 is brought back. This enables the golfer 8 to move the club 10 is a manner such that the end 17 of the shaft remains over or "covering" the line A-A, without allowing the end 17 of the shaft to deviate from the line so as to move outside the plane X-X. This ensures that the club moves along the desired swing plane X-X.

Figure 5:
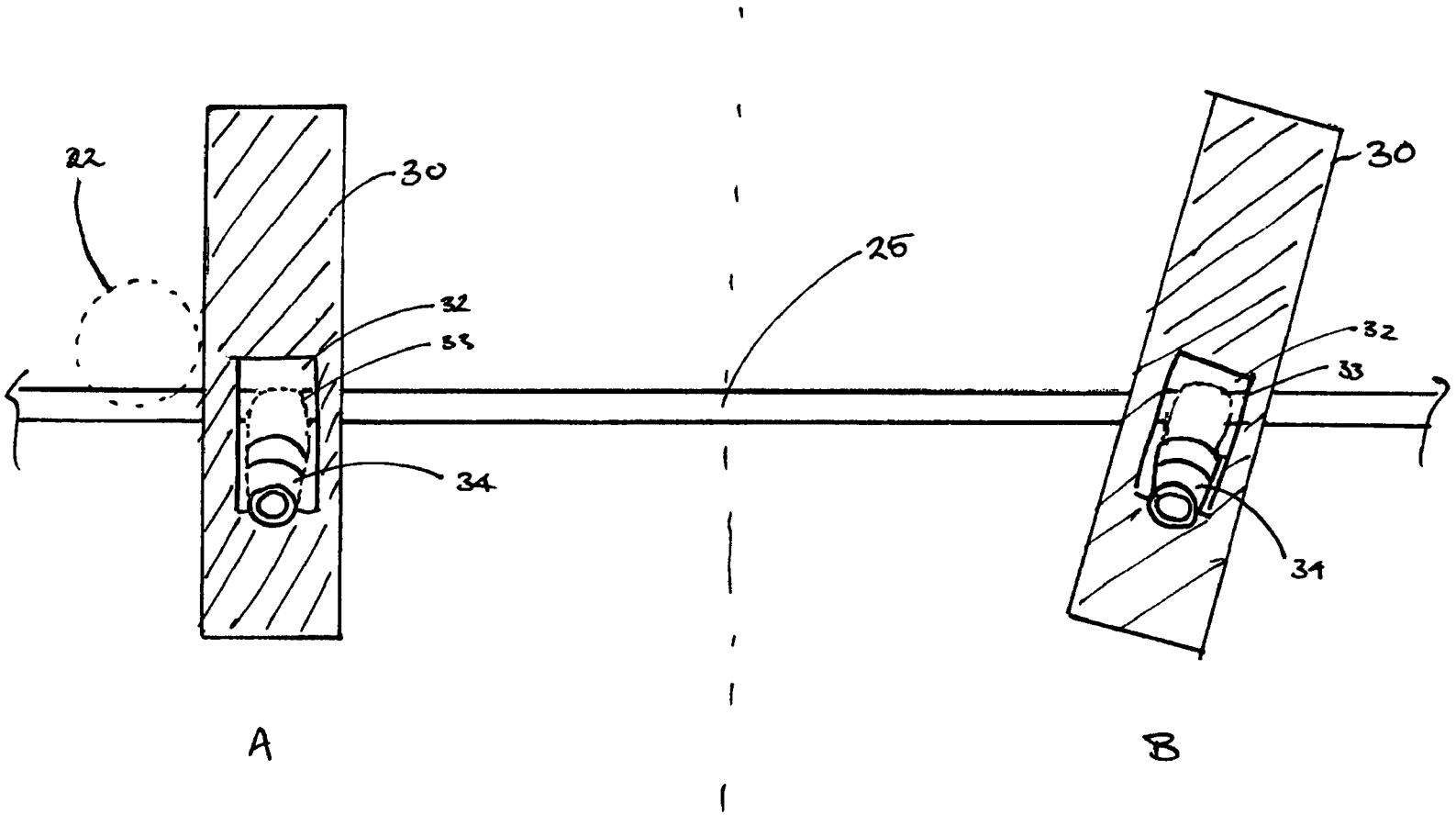
FIG. 5 shows one embodiment of employing a golf club in accordance with the present invention to monitor the swing plane of the club during a stroke.

This can be more clearly seen in FIG. 5, where the present invention is employed with respect to a standard putter 30. FIG. 5 depicts the view seen by a golfer in a putting position, ie. standing over a ball 22 with the ball 22 and putter 30 aligned with respect to a hole (not shown). At the starting position of the stroke, shown as position A, the putter 30 can be seen as having a see-through/transparent window 32 that enables the golfer to view the end 33 of the shaft 34, which is located within a head of the putter 30. A line 25, such as a string line or a chalk line, is provided on the putting surface to establish a straight visual target line, such as line A-A discussed above. The line 25 can also be clearly seen through the see-through/transparent window 32, such that the golfer can position the end 33 of the shaft 34 above the line 25 such that the end of the shaft 34 covers the line 25.

As the golfer commences the putting stroke, the putter 30 is moved behind the ball in the backswing to position B. During this motion, the putter 30 moves along a desired swing plane, as discussed above. This can be determined by the golfer monitoring the end 33 of the shaft 34 to ensure that the end 33 covers the line 25 during the backswing. As the golfer can clearly view the end 33 of the shaft 34, as well as the line 25 through the see-through/transparent window 32 of the club 30, the golfer can visually determine the swing plane of the putter 30.

Similarly, as the putter 30 is moved from position B to position A so as to contact the ball 22 and send the ball 22 towards the hole, the golfer can monitor the stroke by ensuring that the end 33 of the shaft 34 traces/covers the line 25 during the down stroke.

Figure 6:
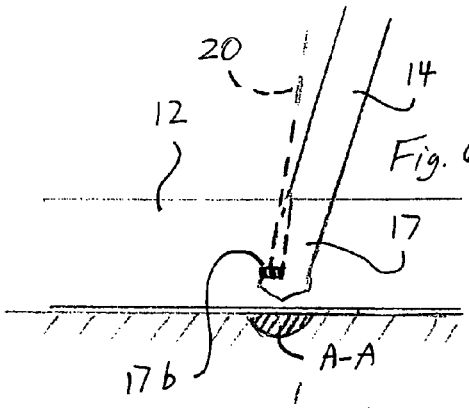
FIG. 6 shows a front elevation of the head of an alternative embodiment of a golf club according to the present invention.
Figure 7:
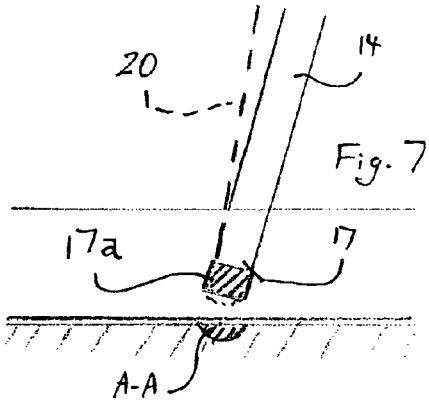
FIG. 7 shows a front elevation of the head of another alternative embodiment of a golf club according to the present invention.
Figure 8:
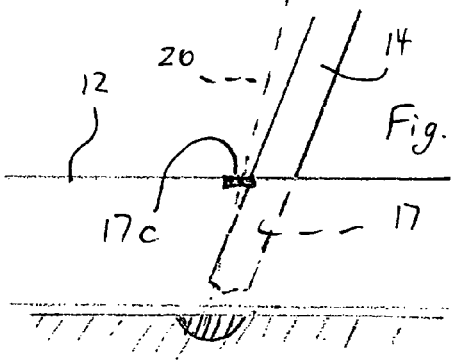
FIG. 8 shows a front elevation of the head of a yet further alternative embodiment of a golf club according to the present invention.

In the embodiments of FIGS. 6, 7, and 8 there are illustrated different possible arrangements in which the first end 17 of the shaft 14 is visually enhanced to facilitate viewing of that end of the shaft during the swing. The end 17 of the shaft is highlighted to enhance visibility thereof compared to surrounding portions of the head 12 by one or more of: providing the end 17 in a bright colour and/or in a contrasting colour as schematically indicated at 17*a* in FIG. 7, or by providing the end 17 with a phosphorescent material (also 17*a* in FIG. 7, or on surfaces 17*b* and 17*c* facing the golfer in FIGS. 6 and 8), and/or providing the first end 17 with light emitting means at position 17*c* in FIG. 8 directed towards the golfer, and/or providing the first end 17 with retro-reflective material, e.g. on surfaces 17*b* and 17*c* facing the golfer in FIGS. 6 and 8. In all these embodiments, the head is shown as composed of transparent material, such as an acrylic polymer, and as illustrated in use the end 17 overlies the straight line A-A on the ground leading to the target. The points 17*a*, 17*b*, 17*c* which provide the enhanced visibility are all in the direct line 20 from the golfer's eyes to the target line A-A on the ground.

Figure 9:
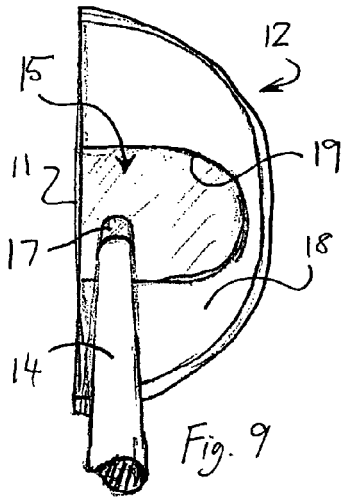
FIGS. 9 and 10 show respectively a top view and a view from the front and above of a still further alternative embodiment of a golf club according to the present invention.
Figure 10:
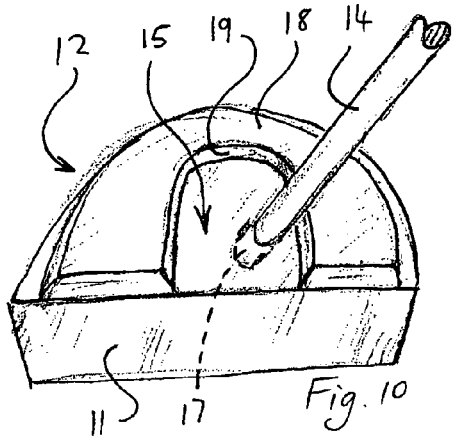

In FIGS. 9 and 10 the club head 12 is generally semicircular in plan view, and the portion or region 15 of the head 12 adjacent the first end 17 of the shaft 14 is formed such that the golfer is able to see through that portion 15 so as to view a ground surface below the head. The transparent portion 15 of the head, as viewed by the golfer holding the club in the address position, surrounds the first end 17 of the shaft and the transparent portion 15 is configured to draw the focus of the golfer's attention to the transparent portion and to the first end 17 of the shaft therein. This is achieved by providing the transparent portion 17 with a configuration to have boundaries 19 which form a visual framing of the first end 17 of the shaft. This visual framing is comprised by a visually demarcated concave boundary at least partially surrounding the location where the first end 17 of the shaft 14 extends into the head 12. In FIGS. 9 and 10 the framing boundary 19 is defined by a metal plate 18 or similar fixed to the top surface of the main transparent body of the head 12 which can also provide added mass to the club head to create the desired feel for the club 10. The framing boundary 19 also in this illustrated embodiment defines a window immediately behind the end 17 relative to the front face 11 so that the user can see the ground and the line A-A thereon immediately behind the end 17 thus assisting accurate placement of the club head in relation to the line A-A.

The embodiment in FIG. 1 is also shown having a visual boundary 19 framing the end 17 of the shaft 14, in that case the boundary being defined by the interface between the clear region 15 and the opaque remaining bulk of the head 12.

Figure 11:
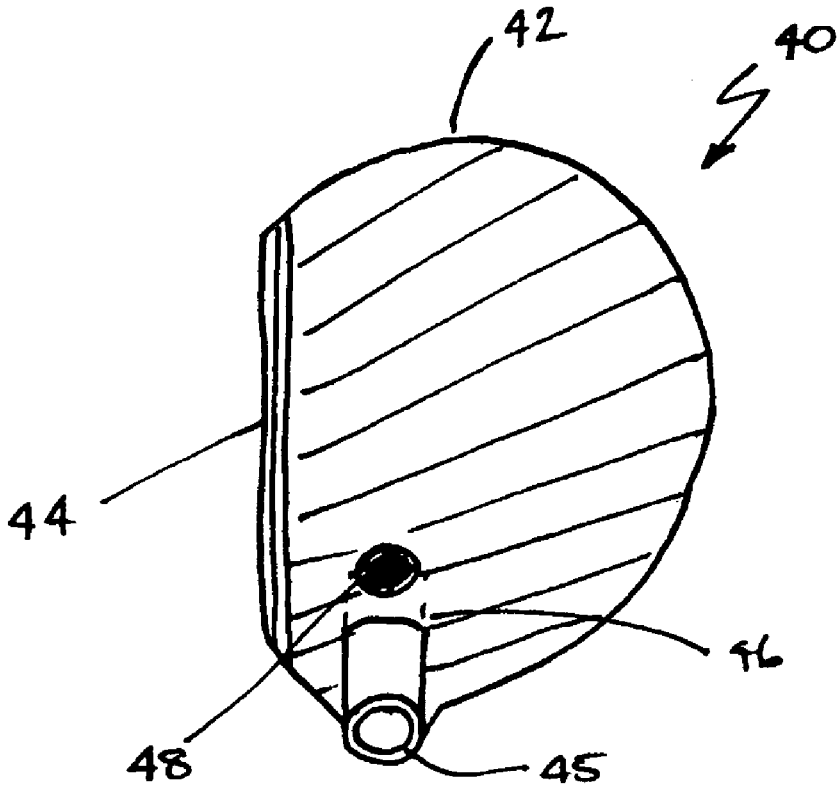
FIG. 11 shows a top view of another possible embodiment of a golf club according to the present invention.

Referring to FIG. 11, there is shown an alternative embodiment of a golf club 40 according to the present invention. As shown, the golf club 40 is a conventional driver having a standard head 42 with a striking face 44. A shaft 45, of a conventional type, is received within a hosel 46 and secured in position such that as the shaft 45 is swung by the golfer, motion is transferred along the shaft to the head 42 for striking a ball (not shown).

In this embodiment, the head 42 is not partially or fully transparent/see-through, however a visual indicator, such as an enlarged dot 48 is located on the upper surface of the head 42 to aid the golfer in monitoring their swing. The position of the dot 48 is determined to precisely indicate the position of the end of the shaft 45 located within the head 42. This is shown by the end of the shaft 45 being represented by the broken line, with the dot 48 being positioned directly above/over the end of the shaft 45. In this manner, the golfer, rather than following the path of the end of the shaft 45 as discussed above, follows the path of the dot 48 through out the swing, with respect to the target line.

Referring to each of the embodiments above, an ability to visually monitor the motion of the club during a stroke, including the address, back-swing, down-stroke and follow-through, enables a golfer to determine whether the club moves within a desired swing plane. This ability enables the preferred swing plane angle to be fitted into the golfer's swing. The golfer is able to be mindful of the need to look closely and monitor the end of the shaft such that it covers/traces a pre-determined straight target line, or is parallel to such a target line during the stroke motion. By slowly performing this action, in an inch-by-inch mode, the golfer is able to create a more controlled golf swing that follows an inclined elbow swing plane.

Figure 12:
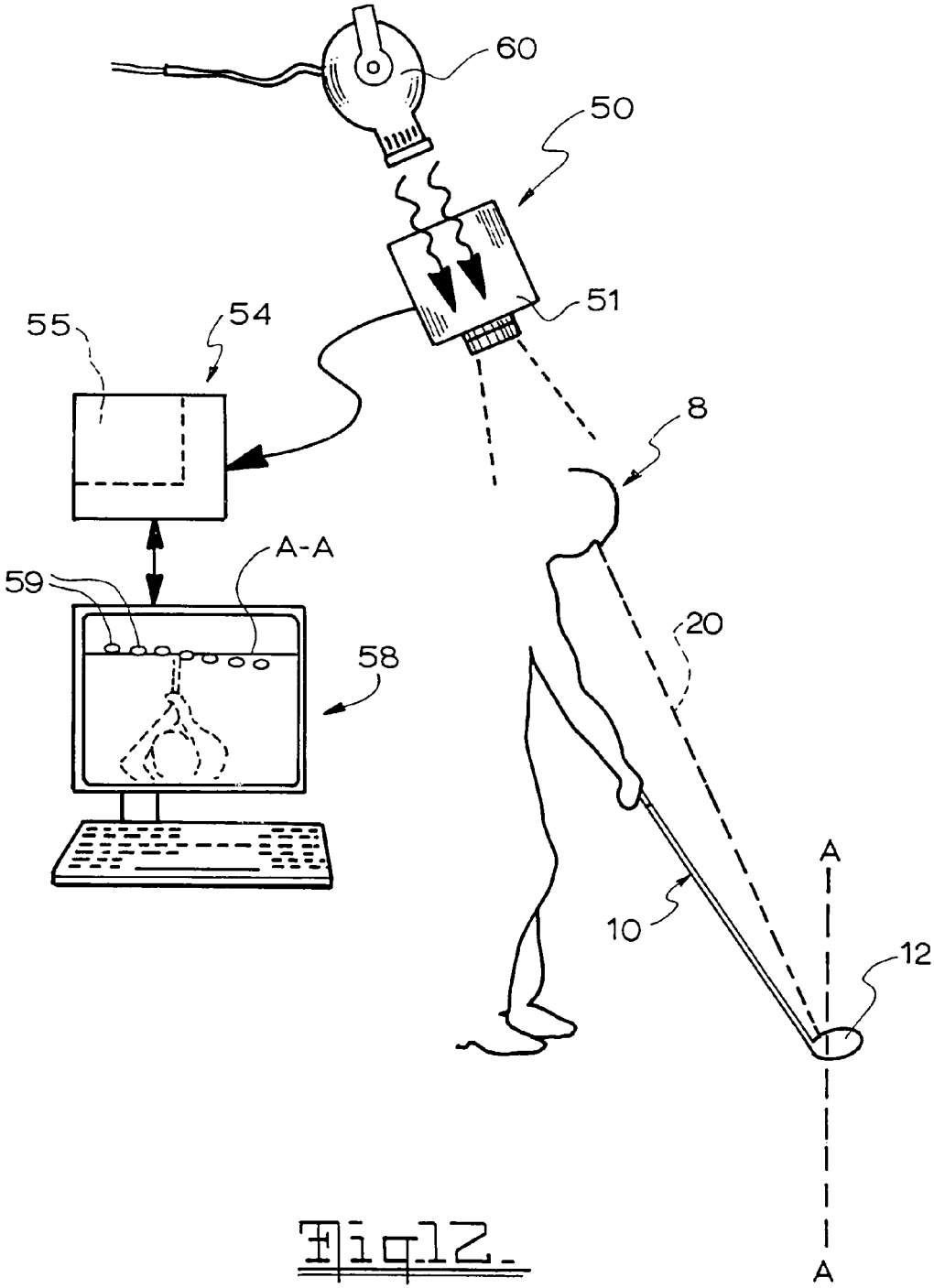
FIG. 12 shows a view from behind a golfer and associated apparatus for performing a method according to an aspect of the present invention.

FIG. 12 is provided to illustrate a system and method of assessing the golf swing of the golfer 8. Provided on the ground is a straight target line A-A along which a golf ball (not shown) placed on the line is to be impelled by the golfer 8 swinging the golf club 10, with the golfer being positioned at one side of the line A-A. A video capture apparatus 50 including a video camera 51 is located above the ground and directed towards the straight target line A-A from above the golfer's head, and for example over the shoulder, so that when the video image capture apparatus 50 is operated the images captured thereby closely approximate the view of the golfer along the line 20. In operation the video image capture apparatus 50 captures a sequence of images as the golfer 8 swings the golf club 10 which is a club in accordance with any one of the previously described embodiments to strike the golf ball placed on the straight target line A-A. The image capture apparatus 50 is operated throughout at least the part of the golfer's swing when the club head 12 approaches and travels through the impact zone where the head of the golf club strikes the golf ball, whereby the image capture apparatus captures successive images of the target scene which includes the straight target line A-A, the golf ball, the golf club head 12, and at least the lower portions of the golf club shaft 14. Later the positions of the first end 17 of the shaft 14 in successive captured images are reviewed in relation to the straight target line A-A so as to assess the golfer's action in swinging the golf club in a desired swing plane in which the straight target line is located.

The images captured by the video image capture apparatus 50 are recorded as image data in a machine readable memory 55 of the computer or other processing system 54. The system is programmed and operated to replay the captured and recorded images by retrieving the image data from the memory 55 and displaying images on display unit 58 in a sequential process at a substantially slower rate than the rate at which the images were captured.

The images captured by the video image capture apparatus 50 are processed in an image analysis operation performed by the programmed processing system 54. In the analysis operation, the system performs the steps of:

identifying in each captured image the straight target line A-A, e.g by finding a straight line of pixels of strongly contrasting visibility to the background using conventional image processing software, identifying in each successive captured image a point location of the first end of the shaft, e.g by searching each image, in an expected area for the point to appear (such as in close proximity to the target line) using conventional image processing software to find a small number of pixels with strongly contrasting visibility to surrounding pixels and also relative to preceding images, plotting the point locations in relation to the straight target line, and displaying on the image display 58 all of the identified point locations 59 in conjunction with an image of the straight target line A-A to demonstrate by the displayed image the line of travel of the head 12 of the golf club 10 and enable inferences to be drawn about the golfer's swing.

The system in FIG. 12 has a light source 60 projecting light from a location adjacent the location of the video image capture apparatus 50 and towards the straight target line A-A. Using a head 12 of the golf club 10 with a body of strongly reflective material indicating the position of the first end 17 of the shaft, such as using the embodiments of FIG. 6 or 8, the video image capture apparatus 50 will capture successive images clearly indicating the exact location of the first end 17 of the shaft by the point of strongly reflected light from the reflective body.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A golf club comprising:

a head having a face configured to contact a ball; and a shaft attached to said head at a first end such that the first end extends into and is received within said head, the shaft being configured to be gripped by a golfer at a second end so as to be swung by the golfer such that the face of the head strikes the ball thereby imparting motion to the ball;

wherein a terminal region of the first end of the shaft is visually enhanced by highlighting compared to at least one of the surrounding portions of the head and a reference surface thereby facilitating viewing of the first end of the shaft against the reference surface during a swing of the golf club;

with the visual enhancement involving one or more of: providing said terminal region of the first end of the shaft in a bright colour, providing the terminal region of the first end of the shaft in a contrasting colour, providing the terminal region of the first end of the shaft with a phosphorescent material, providing the terminal region of the first end of the shaft with light emitting means directed toward the golfer, and providing the terminal region of the first end of the shaft with retro-reflective material; and wherein at least a portion of the head adjacent a terminal region of the first end of the shaft is transparent such that a terminal end of the first end of the shaft is visible to the golfer against the reference surface located below the head to provide the golfer with a visual indication of the position of the terminal end of the first end of the shaft against said reference surface such that a path of the terminal end of the first end of the shaft is monitored during said swing.

2. A golf club according to claim 1 wherein said transparent portion completely surrounds the first end of the shaft where it extends into and is received within said head.

3. A golf club according to claim 1 wherein the reference surface is a ground surface located below the head.

4. A golf club according to claim 1 wherein the transparent portion of the head, as viewed by the golfer holding the club in the address position, surrounds the first end of the shaft and wherein the transparent portion is configured to draw the focus of the golfer's attention to the transparent portion and to the terminal end of the first end of the shaft against the reference surface.

5. A golf club as claimed in claim 4 wherein the transparent portion is configured to have boundaries which when viewed by the golfer holding the club in the address position forms a visual framing of the terminal end of the first end of the shaft against the reference surface.

6. A golf club as claimed in claim 5 wherein the visual framing is comprised by a visually demarcated concave boundary at least partially surrounding the location where the first end of the shaft extends into said head.

7. A golf club according to claim 1, wherein the head includes a visual marker that indicates the position of the terminal region of the first end of the shaft to the golfer holding the club in the address position.

8. A golf club according to claim 7, wherein the visual marker is provided as a marking on an upper surface of the head.

9. A golf club according to claim 8, wherein the marking is located such that it is directly above the terminal region of the first end of the shaft received within the head so as to be in a direct line drawn from the golfer's eyes when in the address position to the first end of the shaft.

* * * * *